United States Patent [19]

Dickson, Jr.

[11] 4,052,019

[45] Oct. 4, 1977

[54] APPARATUS AND METHOD FOR WINDING ELASTOMERIC FIBER

[75] Inventor: Thomas David Dickson, Jr., San Jose, Calif.

[73] Assignee: Alza Corporation, Palo Alto, Calif.

[21] Appl. No.: 677,240

[22] Filed: Apr. 15, 1976

[51] Int. Cl.[2] ..... B65H 54/00; B65H 63/08

[52] U.S. Cl. ..... 242/47; 242/18 R; 242/39; 242/45

[58] Field of Search ..... 242/45, 36, 39, 47, 242/1, 18 R

[56] References Cited

U.S. PATENT DOCUMENTS

| | | | |
|---|---|---|---|
| 1,962,029 | 6/1934 | Murphy et al. | 242/45 |
| 2,199,550 | 5/1940 | Tobias | 242/45 |
| 2,246,917 | 6/1941 | Francis | 242/45 |
| 2,269,299 | 1/1942 | Wiggins | 242/45 |
| 2,290,628 | 7/1942 | Alderfer | 242/45 UX |
| 2,306,660 | 12/1942 | Gift, Jr. | 242/45 |

*Primary Examiner*—Stanley N. Gilreath
*Attorney, Agent, or Firm*—Thomas E. Ciotti; Paul L. Sabatine; Edward L. Mandell

[57] ABSTRACT

An apparatus and method for winding an elastomeric fiber under no or low tension in which a spool of the fiber is placed between a pair of spaced rotating wheels thus causing the spool to rotate at a predetermined linear velocity, and the fiber is first passed from the spool around a take off pulley rotating faster than the spool, then around a substantial portion of the circumferences of a series of guide sheaves, each of which is rotating at the predetermined velocity, and then onto a wind up reel that is also rotating at the predetermined velocity. The speed of the rotating wheels is adjusted during the winding to compensate for the decrease in the spool's diameter as the fiber is unwound from it and for any inherent tension in the spooled fiber in order to keep the spool rotating at substantially the predetermined velocity.

6 Claims, 3 Drawing Figures

APPARATUS AND METHOD FOR WINDING ELASTOMERIC FIBER

FIELD OF THE INVENTION

This invention relates to an apparatus and method for winding elastomeric fibers at no or very low axial tension.

SUMMARY OF THE INVENTION

The invention is an apparatus and a method for winding an elastomeric fiber under no or very low axial tension. The apparatus comprises in combination: a housing; a pair of wheels mounted on the housing in spaced relationship to each other that are adapted to hold a spool of the fiber in the space between them and rotate the spool in response to their rotation; a fiber take off pulley mounted on the housing over which the fiber from the spool is threaded; at least one fiber guide sheave over which the fiber is threaded from the take off pulley such that the fiber is wrapped about a substantial portion of its circumference; a wind up reel mounted on the housing onto which the fiber is threaded from the fiber guide sheave and wound; means, such as one or more electric motors, for driving the pair of wheels, the fiber take off pulley, the fiber guide sheave, and the wind up reel whereby the same are driven such that the linear speeds of the spool of fiber, the fiber guide sheave, and the wind up reel are susbtantially equal and the linear speed of the fiber take off pulley is substantially greater than the linear speed of the spool; and means associated with the pair of wheels for varying the rotational speed thereof whereby the linear speed of the spool may be varied to compensate for its decrease in diameter as fiber is unwound therefrom and any inherent axial tension in the fiber on the spool and thereby maintain the linear speed of the spool substantially equal to that of the wind up reel.

The method involves the steps of: rotating said spool at a predetermined velocity so that the fiber is unwound therefrom; passing the fiber from the spool around said fiber take off pulley while rotating the take off pulley at a linear velocity substantially greater than said predetermined velocity; passing the fiber from the take off pulley around a substantial portion of said fiber guide sheave while rotating the sheave at substantially said predetermined linear velocity; passing the fiber from the fiber guide sheave onto a wind up reel while rotating the wind up reel at substantially said predetermined linear velocity; and adjusting the rotational velocity of the spool to compensate for its decrease in diameter as fiber is unwound therefrom so as to maintain the linear velocity of the spool at substantially said predetermined linear velocity.

DESCRIPTION OF THE PREFERRED EMBODIMENT

The drawings show a fiber winding apparatus, generally designated 11, that may be used in preparing bundles of fibers for use in the fluid flow control of U.S. Pat. No. 3,831,600. The fibers that are used in that control are preferably Lycra Spandex and have been subjected to little or no axial extension. Such fibers have excellent long term stability which contributes greatly to the reliability of the control. Apparatus 11 makes bundles of such fibers by winding a continuous length of Lycra Spandex fiber a predetermined number of revolutions under no or very low axial tension.

Figure 2:
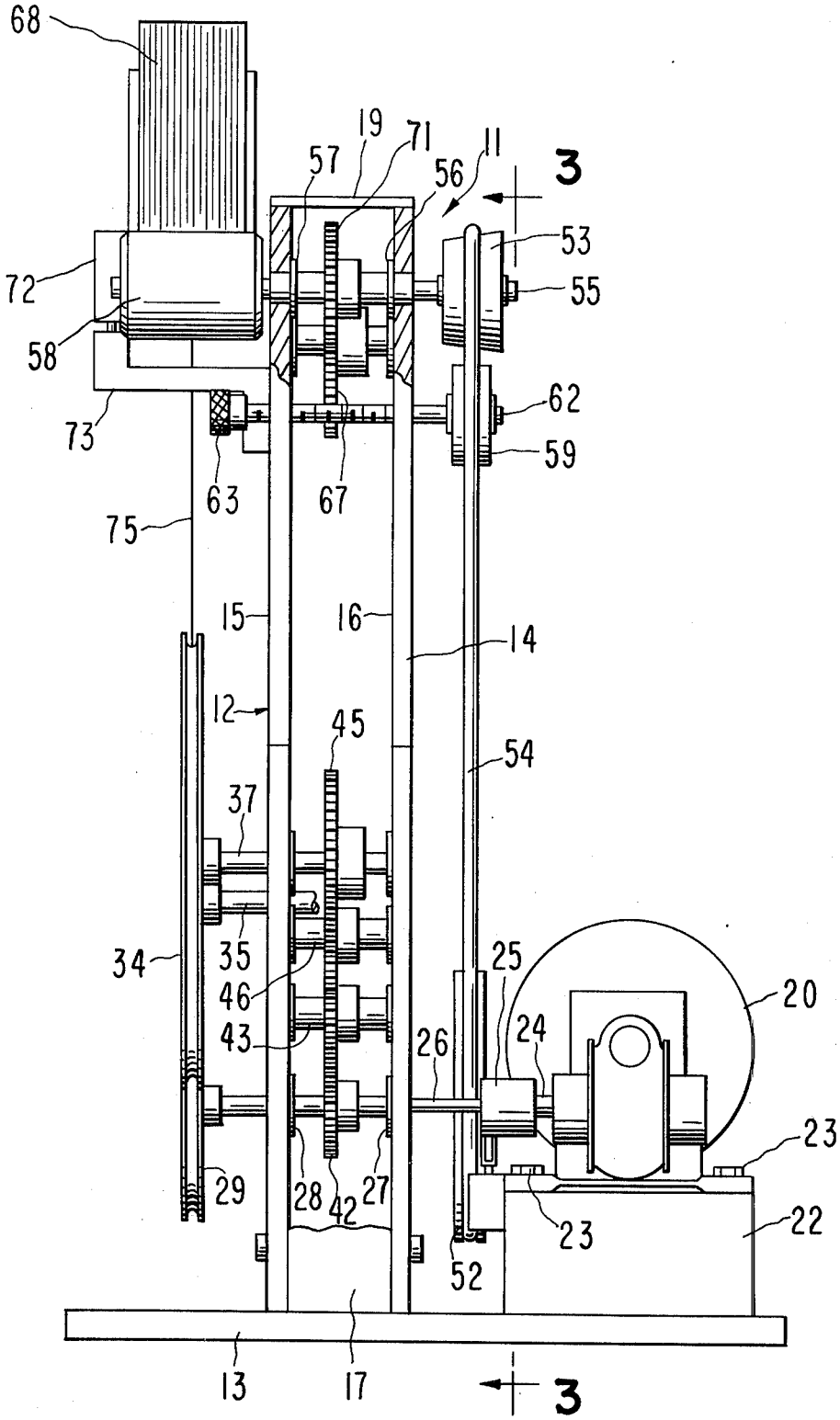
FIG. 2 is a side view of the apparatus of FIG. 1 partly in section and partly cut away.

Referring to FIG. 2, apparatus 11 includes a housing, generally designated 12, that is composed of a base plate 13 and an upstanding, generally rectangular enclosure 14 defined by a portion of base plate 13, a pair of spaced opposed side plates 15, 16, a pair of spaced, opposed end plates 17, 18 (FIG. 3), and a top plate 19. Enclosure 14 is affixed rigidly to base plate 13 by conventional means, such as bolts. The component plates of enclosure 14 are affixed similarly to each other.

Housing 12 provides a mounting site for a variable speed electric motor 20 and the various winding pulleys and sheaves of apparatus 11. Motor 20 is mounted on top of an upstanding support block 22 by bolts 23. Support block 22 is attached rigidly to the top side of base plate 13. Motor 20 is adapted to be connected to line voltage and is the means by which apparatus 11 is driven. The driving shaft 24 of motor 20 is coupled by a coupling 25 to a shaft 26 that extends through side plates 15, 16 and is journalled therein in bearings 27, 28. A sheave 29 is mounted on the front end of shaft 26 outwardly from plate 15. Sheave 29 functions as a guide sheave in the fiber winding operation. Shaft 26 also gear drives a take off drive pulley 31, fiber guide sheaves 32, 33, and a wind up reel 34 each of which is mounted on a shaft that extends through and is journalled in side plates 15, 16. Specifically, guide sheave 32 is mounted on a shaft 35; guide sheave 33 is mounted on a shaft 36; wind up reel 34 is mounted on a shaft 37; take off drive pulley 31 is mounted on a shaft 40.

Figure 3:
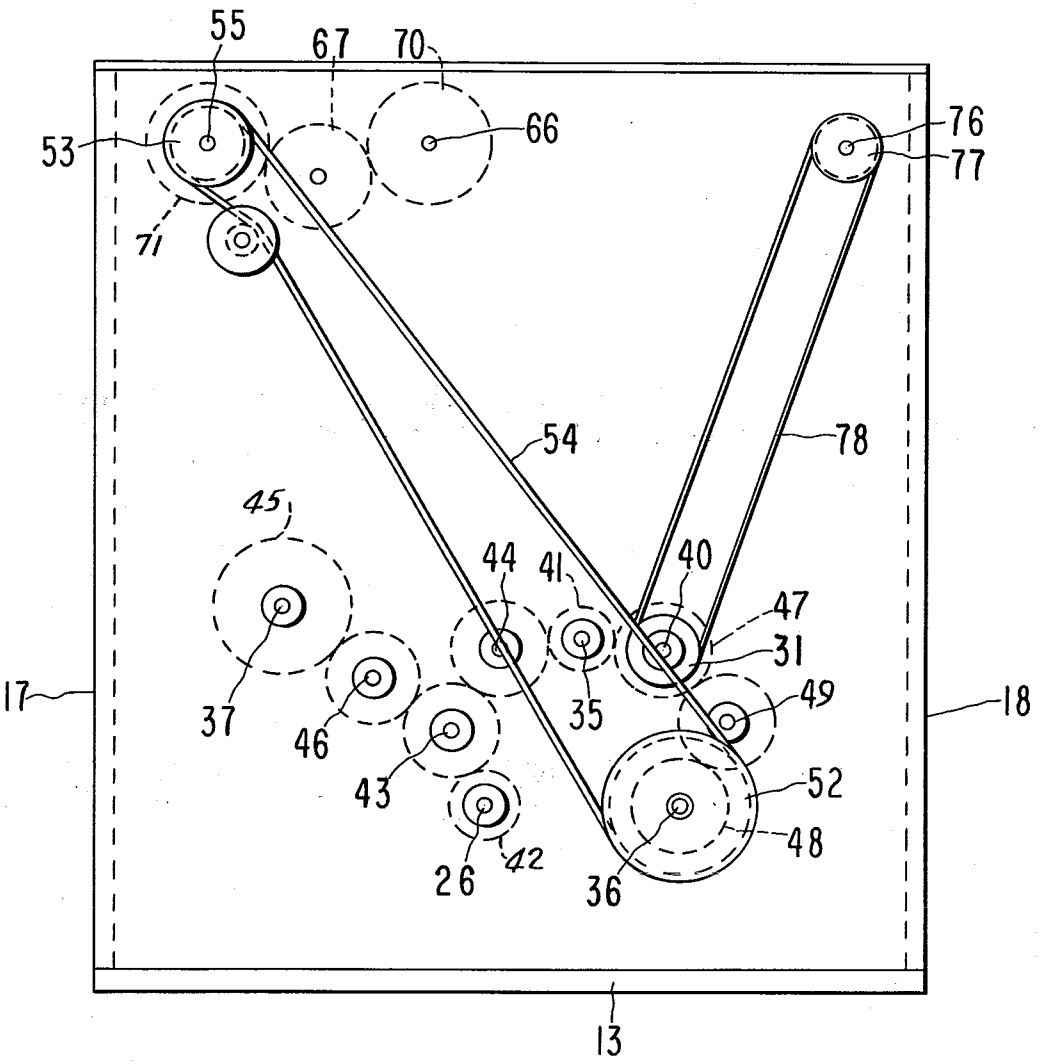
FIG. 3 is a rear view of the apparatus of FIG. 1 taken along line 3—3 of FIG. 2

Sheaves 29, 32, and 33 and reel 34 are driven at substantially the same speed. Thus their respective shafts are interconnected by a gear train located between plates 15, 16. As partly illustrated in FIGS. 2 and 3 shaft 26 has a driving gear 42 mounted on it that is geared to: a gear 41 (shown in dashed lines in FIG. 3) on shaft 35 via idler gear assemblies 43, 44; a gear 45 on shaft 37 via idler gear assemblies 43, 46; a gear 47 (shown in dashed line in FIG. 3) on shaft 40 via idler gear assemblies 43, 44 and the gear on shaft 35; and a gear 48 (shown in dashed line in FIG. 3) on shaft 36 via idler gear assemblies 43, 44, the gears on shafts 35, 40 and another idler gear assembly 49 (FIG. 3).

Referring again to FIGS. 2 and 3, the rear end of shaft 36 has a sheave 52 on it that is interconnected with a tapered pulley 53 by a belt 54. Pulley 53 is attached to the rear end of a shaft 55 that extends through side plates 15, 16 and is journalled therein in bearings 56, 57. The other (front) end of shaft 55 has a cantilevered, flat wheel 58 attached to it. A belt adjust pulley 59 is located just below tapered pulley 59 and generally along the line of belt 54. Pulley 59 is mounted on the rear end of a threaded shaft 62 that extends through side plates 15, 16. The front end of shaft 62 has a head 63 on it that serves as a finger grip for use in adjusting the front-toback position of pulley 59 and correlatively the position of belt 54 on tapered pulley 53.

Figure 1:
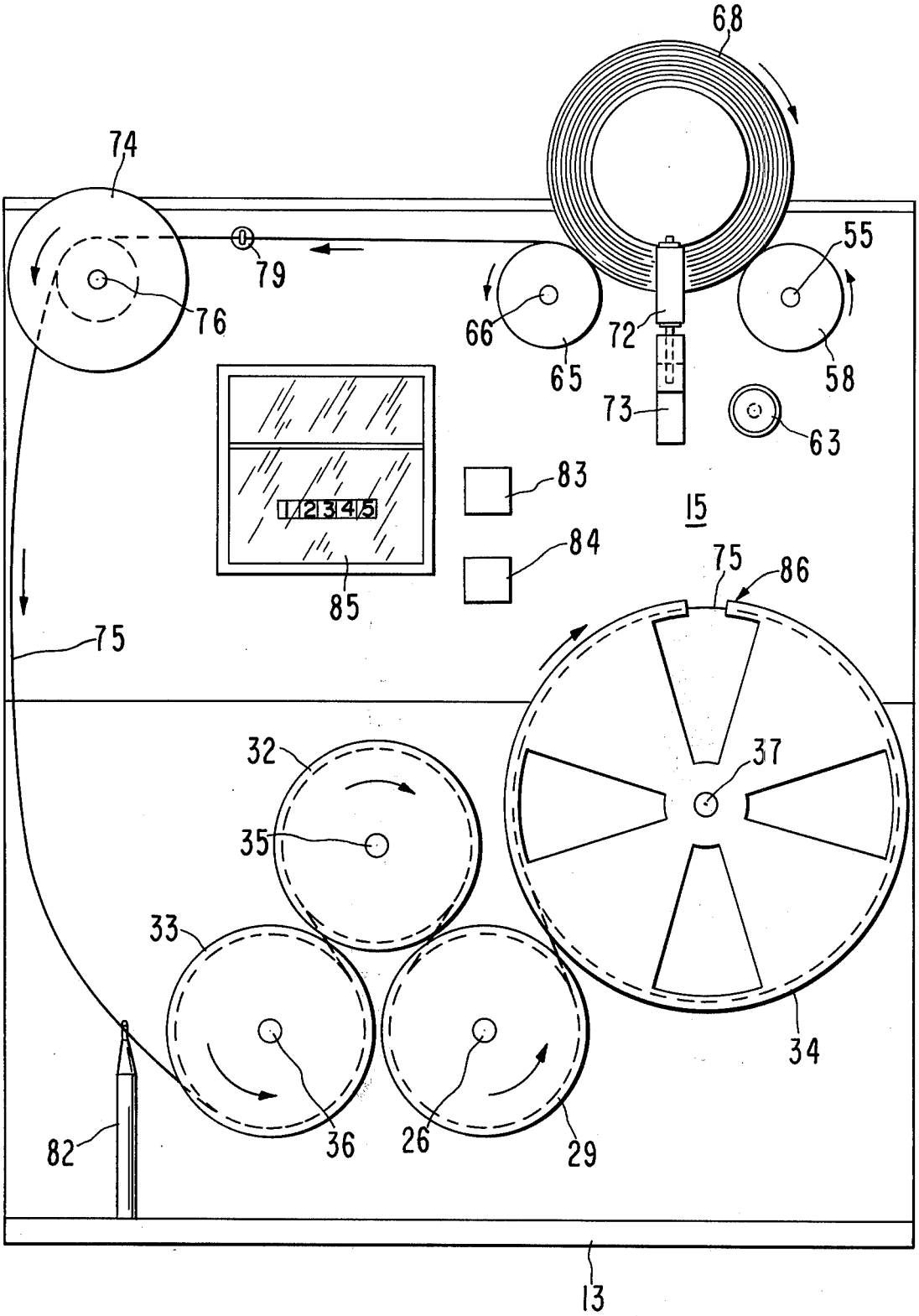
FIG. 1 is a front elevational view of the fiber winding apparatus of the invention.

As shown in FIG. 1 a second cantilevered, flat wheel 65 is mounted parallel to wheel 58 on a shaft 66 that extends through and is journalled in plates 15, 16. Shaft 66 has a driven gear 70 (shown in dashed line in FIG. 3) on it that is geared to a driving gear 71 on shaft 55 via an idler gear 67. Wheels 58, 65 provide support for a spool 68 of fiber 75. Lateral support for spool 68 is provided by plate 15 and a lateral roller 72 journalled in a bracket 73 mounted on the front of plate 15. A take off pulley 74 is mounted at the top front corner of plate 15 nearest end plate 18 on the front end of a shaft 76. Shaft 76 extends through and is journalled in plates 15, 16 and has a sheave 77 on its rear end. Sheave 77 is connected to take off drive pulley 31 by a belt 78. There is a fiber guide eyebolt 79 attached to plate 15 between wheel 65 and take off pulley 74. Fiber 75 passes through eyebolt 79 prior to reaching take off pulley 74. There is also an upstanding fiber guide post 82 attached to base plate 13 adjacent guide sheave 33 through which fiber 75 passes before being wrapped about guide sheave 33.

Apparatus 11 is equipped with on/off switches 83, 84 that are appropriately wired to motor 20 and with a wind counter 85 that detects and records each revolution of shaft 37. Shaft 37 is equipped with an appropriate signal means (not shown), such as an eccentric which contacts a micro switch, and counter 85 is equipped with corresponding signal detecting means (not shown) that is responsive to the signal generated by the signal means e.g. the signal from the micro switch. Counter 85 is also adapted to shut the motor off after a predetermined number of winds have been made.

In order to wind fiber 75 about wind up reel 34 under no or very low tension (i.e., less than 10% axial elongation, and preferably less than 5% axial elongation) it is necessary to equalize the linear speeds of wind up reel 34 and spool 68 and to compensate for any significant inherent tension in the fiber on the spool (the spooled fiber may be under an inherent axial elongation of up to about 10%). In this regard as the fiber is taken off spool 68 the diameter of spool 68 decreases causing the inherent tension in the spooled fiber to increase. Such equalization and compensation are made by adjusting the position of belt 54 on tapered pulley 53 by moving belt adjust pulley 59 toward or away from side plate 16 by turning threaded shaft 62. The taper of pulley 53 should be such as to allow for up to about 10% variation in speed.

Also, the respective sizes of sheave 31, gear 47 and pulley 77 should be such that the linear speed of take off pulley 74 is substantially greater than the linear speed of the edge of spool 68. This places fiber 75 under tension between wheel 65 and take off pulley 74 so that the fiber 75 does not wrap back around spool 68. This difference in speed also causes slippage pulley 74 and fiber 75.

The linear speeds of sheaves 29, 32 and 33 and wind-up reel 34 are substantially equal. The linear speeds of wheels 58 and 65 are substantially equal.

Since fiber 75 is slack after it clears pulley 74 it is necessary to subject it to substantial control before it reaches wind up reel 34 so that it is wound cleanly about reel 34. As seen in FIG. 1 this control is accomplished by passing it about a substantial portion of the circumferences of each of sheaves 33, 32, and 29, usually at least about half of each circumference.

Fiber 75 is wound by appartus 11 as follows. Motor 20 is connected to line voltage via a silicone rectifier dc controller and counter 85 is set to the desired number of winds. Then spool 68 is placed on wheels 58, 65 and between rollers 69, 72 as shown in FIG. 1. Fiber 75 is then threaded through apparatus 11 as seen in FIG. 1. Belt 54 is then moved to the large end of tapered pulley 53 by gripping head 63 and turning shaft 62 so that belt adjust pulley 59 moves away from plate 16. This ensures that fiber 75 will not be broken during the initial power surge when the apparatus is turned on. The apparatus 11 is then turned on by pressing on switch 83 and the position of belt 54 is adjusted immediately so that fiber 75 is neither so loose that it tangles nor so tight that it breaks. Fiber 75 should be slack between pulley 74 and sheave 33 (as shown in FIG. 1) and not tightly wrapped about sheaves 33, 32, and 29. The speed of spool 68 may have to be adjusted periodically as described above to maintain these conditions. After the predetermined number of windings counter 85 shuts off motor 20 automatically. If fiber 75 tangles or breaks before this occurs, the apparatus may be shut off by pressing off switch 84.

The wrappings of fiber 75 are then cut at notch 86 on the edge of wind up reel 34 and removed from around reel 34. The resulting bundle of fibers has a length that is equal to the circumference of reel 34 and the number of fibers in the bundle is equal to the number of windings about reel 34.

Modifications of the apparatus and method described above that are obvious to those of skill in the mechanical and related arts are intended to be within the scope of the following claims.

I claim:

1. Apparatus for winding an elastomeric fiber under no or low axial tension comprising in combination:

a. a housing;

b. a pair of wheels mounted on the housing in spaced relationship to each other that are adapted to receive and hold a spool of said fiber in the space between them and rotate the spool in response to their rotation;

c. a fiber take off pulley mounted on the housing over which the fiber from the spool is threaded;

d. at least one fiber guide sheave mounted on the housing over which the fiber is threaded from the fiber take off pulley such that the fiber is wrapped about a substantial portion of its circumference;

e. a wind up reel mounted on the housing into which the fiber is threaded from the fiber guide sheave and wound;

f. means for driving the pair of wheels, the fiber take off pulley, the fiber guide sheave, and the wind up reel whereby the same are driven such that the linear speeds of the spool of fiber, the fiber guide sheave, and the wind up reel are substantially equal and the linear speed of the fiber take off pulley is substantially greater than the linear speed of the spool of fiber; and g. means associated with the pair of wheels for varying the rotational speed thereof whereby the linear speed of the spool of fiber may be varied to compensate for its decrease in diameter as the fiber is taken off it and any inherent axial tension in the fiber on the spool and thereby maintain the linear speed of the spool substantially equal to that of the wind in up reel.

2. The apparatus of claim 1 wherein there is a plurality of fiber guide sheaves about which the fiber is threaded such that the fiber is wrapped over at least about half the circumference of each fiber guide sheave.

3. The apparatus of claim 1 wherein the means for varying the linear speed of the pair of wheels includes a tapered pulley mounted commonly with one of the wheels of said pair, a belt interconnecting the tapered pulley with said means for driving the pair of wheels, and means for varying the position of the belt about the tapered pulley.

4. The apparatus of claim 1 wherein the driving means is a motor whose driving shaft is interconnected with the pair of wheels, the fiber take off pulley, the fiber guide sheave and the wind up reel.

5. The apparatus of claim 3 wherein the means for varying the position of the belt is a pulley that is mounted on the housing such that it is movable along the line of the belt and parallel to the axis of the tapered pulley.

6. Method for winding an elastomeric fiber under no or very low axial tension comprising the steps of:

a. rotating a spool of said fiber at a predetermined linear velocity so that the fiber is unwound from the spool;

B. passing the fiber from the spool around a fiber take off pulley while rotating the fiber take off pulley at a substantially greater linear velocity than said predetermined linear velocity;

C. passing the fiber from the fiber take off pulley around a substantial portion of the circumference of at least one fiber guide sheave while rotating the fiber guide sheave substantially at said predetermined linear velocity;

d. passing the fiber from the fiber guide sheave onto a wind up reel while rotating the wind up reel substantially at said predetermined linear velocity; and e. adjusting the rotational velocity of the spool of fiber to compensate for the decrease in the diameter of the spool as the fiber is unwound therefrom so as to maintain the linear velocity of the spool substantially at said predetermined linear velocity.

* * * * *